US008136739B2

(12) United States Patent
Feinleib et al.

(10) Patent No.: US 8,136,739 B2
(45) Date of Patent: Mar. 20, 2012

(54) METHOD, APPARATUS, AND SYSTEM FOR PROJECTING HOT WATER AVAILABILITY FOR BATHING

(76) Inventors: David Feinleib, Menlo Park, WA (US); R. Alan Burnett, Bellevue, WA (US); Marianne E. Phillips, Kirkland, WA (US)

( * ) Notice: Subject to any disclaimer, the term of this patent is extended or adjusted under 35 U.S.C. 154(b) by 117 days.

(21) Appl. No.: 12/426,355

(22) Filed: Apr. 20, 2009

(65) Prior Publication Data

US 2010/0141422 A1 Jun. 10, 2010

Related U.S. Application Data

(62) Division of application No. 10/851,612, filed on May 22, 2004, now Pat. No. 7,520,445.

(51) Int. Cl.
*G05D 23/00* (2006.01)
*F24D 19/10* (2006.01)
*G01F 25/00* (2006.01)

(52) U.S. Cl. ..... 236/94; 73/861.01; 237/8 A; 702/100

(58) Field of Classification Search ..... 236/94; 73/861.01; 237/8 A; 702/100
See application file for complete search history.

(56) References Cited

U.S. PATENT DOCUMENTS 5,058,804 A * 10/1991 Yonekubo et al. ..... 236/12.12
6,990,861 B2 * 1/2006 Ham ..... 73/295
2005/0004712 A1 * 1/2005 Stevens et al. ..... 700/266

* cited by examiner

*Primary Examiner* — Marc Norman
(74) *Attorney, Agent, or Firm* — Law Office of R. Alan Burnett, P.S.

(57) ABSTRACT

Methods, apparatus, and system for predicting the availability of hot water for bathing. One or more parameters corresponding to the operation of a water heater are monitored over time and/or a temperature distribution of water in a hot water tank measured. Data corresponding to the monitored parameters and/or temperature distribution are processed to determine a rate at which hot water is being consumed by filling a bath and/or due to other hot water consumers and/or to determine a current hot water availability condition. Based on a hot water consumption rate and/or determination of a current hot water availability condition, a projection is made to whether there will be adequate hot water to fill the bathtub to a desired level or volume at a desired temperature.

19 Claims, 13 Drawing Sheets

$t_0$ $t_1$ $t_2$ $t_3$ $t_4$

METHOD, APPARATUS, AND SYSTEM FOR PROJECTING HOT WATER AVAILABILITY FOR BATHING

CROSS-REFERENCE TO RELATED APPLICATIONS

This application is a divisional of U.S. application Ser. No. 10/851,612 entitled METHOD, APPARATUS, AND SYSTEM FOR PROJECTING HOT WATER AVAILABILITY FOR SHOWERING AND BATHING, filed May 22, 2004, to be issued on Apr. 21, 2009 as U.S. Pat. No. 7,520,445, the benefit of the filing date of which is claimed under 35 U.S.C. §120.

FIELD OF THE INVENTION

The field of invention relates generally to projecting hot water availability, and more specifically relates to a method, apparatus, and system for predicting if a sufficient amount of hot water is available for bathing.

BACKGROUND INFORMATION

The present invention addresses a problem encountered by just about every person at one time or another—drawing a bath and discovering there is insufficient hot water available to fill the bathtub at a desired level and at a desired temperature only after the bathtub is fully or partially filled. There are myriad reasons for why there is insufficient hot water available, such as recent hot water consumption by various appliances and/or people. For example, unbeknownst to the bather, another person or appliance has been using hot water (or at least more hot water than the bather thought was being used), depleting the hot water in the water heater tank.

Typically, a bather will turn on the hot water supply valve or turn a single water control valve to the hot water position and start running water into the bathtub with the drain open until hot water begins to be supplied at the faucet. The bather then adjusts the water supply (either via adding cold water via a second cold water control valve or adjusting the position of a single control value) to obtain the desired temperature and closes the drain to fill the bathtub. The bather then typically walks away while the bathtub fills with water, expecting to return a short time later with a bathtub of hot or warm water. In the meanwhile, the hot water supply becomes depleted, causing the hot water supplied to the bathtub to become cooler and cooler. When the bather returns, she finds the bathtub full of lukewarm water. This is typically followed by some unpleasant verbalization and opening of the drain to drain out the lukewarm water.

There are known solutions to the lukewarm bath, but most are not viable. In the context of a single-family household setting, one solution is to become single again, thereby eliminating other hot water consumers. However, this option generally doesn't sit well with spouses and children. Another solution is to yell at any teenagers in the house, who believe a long shower makes up for a short attention span (as pertains to parents). A potentially more realistic solution is to buy a larger hot water tank, or better yet, multiple hot water tanks. As with the other solutions, this usually is not viable, due to space restrictions and other reasons, such as lack of money due to the spending habits of the spouse and/or teenagers and fear of large payments to the local energy utility. Another option is to buy a tankless water heater, but this may be cost prohibited for many families, particularly those with teenagers who prefer texting to talking. Finally, another option is to boil some water and add it to the bath, but since the bather is already boiling mad she often doesn't have the patience or energy to do so.

SUMMARY OF THE INVENTION

In accordance with aspects of the present invention, methods, apparatus and systems are disclosed that address the foregoing unknown hot water availability problem by providing techniques for projecting if there is adequate hot water available for a bath prior to or soon after beginning to fill the bathtub. The various techniques can be implemented on existing installations and new installations.

According to one set of techniques, one or more parameters corresponding to the operation of a water heater are monitored over time and/or a temperature distribution of water in a hot water tank measured. Data corresponding to the monitored parameters and/or temperature distribution are processed to determine a rate at which hot water is being consumed by filling a bath and/or due to other hot water consumers and/or to determine a current hot water availability condition. Based on the hot water consumption rate and/or determination of the current hot water availability condition, a projection is made to whether there will be adequate hot water to fill the bathtub to a desired level or volume at a desired temperature. In one embodiment, the apparatus include a thermal-modeling computer and a control/monitor interface that is disposed in or proximate to a bathtub. In one embodiment, the thermal-modeling computer is installed at a water heater and data is transmitted between the thermal-modeling computer and the control/monitor interface via a wireless signal.

In another aspect of the present invention, techniques are disclosed for automatically calibrating the thermal characteristics of water heaters. Temperature measurements at one or more locations, such as in the hot water tank, at the exit to the tank, and/or at a supply line to a shower or bath are observed under one or more flow rates over time. Collected data are then processed to generate mathematical-based thermal models of the thermal characteristics of a water heater and/or build lookup tables defining the thermal characteristics.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein like reference numerals refer to like parts throughout the various views unless otherwise specified.

DETAILED DESCRIPTION OF PREFERRED EMBODIMENTS

Embodiments of methods, apparatus, and systems for predicting shower hot water availability are described herein. In the following description, numerous specific details are set forth to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Embodiments of the present invention disclosed herein provide means for predicting hot water availability under various water consumption scenarios, thereby enabling a showerer to know whether he or she should start taking a shower if not yet begun, or know when to finish their shower to avoid another unpleasant blast of cold water. Various techniques are provided, including embodiments that are suited for new installations and existing installation.

Figure 1:
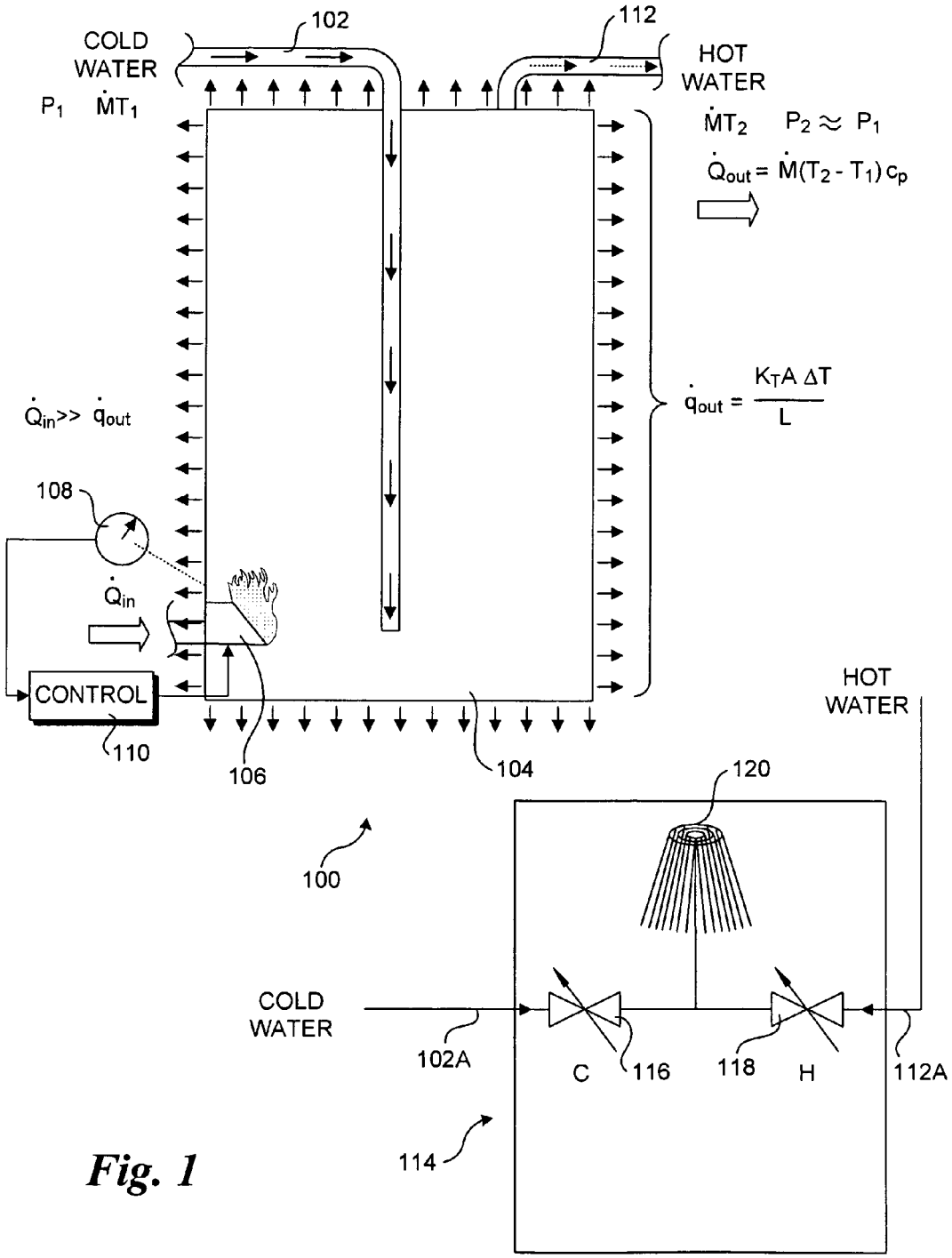
FIG. 1 is a schematic diagram of a typical water heater and shower, and illustrates various heat transfer equations and parameters relating to water heater operations.

To better understand the technical nature of the problem, attention is directed to FIG. 1, which shows the operations of a typical water heater 100. The water heater 100 includes a cold-water input 102, which generally extends downward toward the base of the water heater's tank 104. Thus, cold water entering the tank 104 collects at the bottom at the tank. This cold water is heated by a heater 106, which is typically in the form of a gas heat exchanger or one or more electrical heating elements. The heater 106 is usually controlled by a simple temperature feedback scheme, such as a thermostat 108, which employs a bi-metal element that moves in response to temperature changes. The bi-metal element functions as a type of switch, which causes an on input to be received by a heater controller 110 when the temperature of the water in the tank proximate to the thermostat is below a desired set temperature, and causes the controller to receive an off signal once the temperature is reached. Typically, there is some hysterisis in the control loop, such that the controller 110 does not continuously cycle the heater 106 on and off.

Figure 2A:
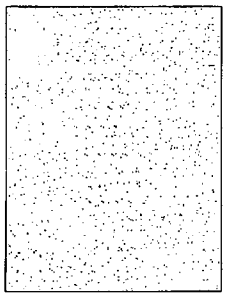
FIGS. 2*a-e* illustrate respective temperature distribution representations with a hot water tank taken a different timeframes.
Figure 2B:
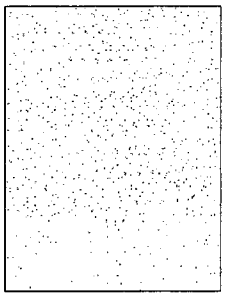
Figure 2C:
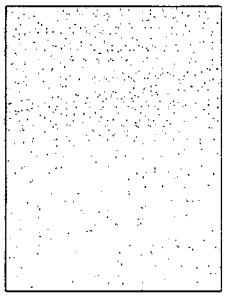
Figure 2D:
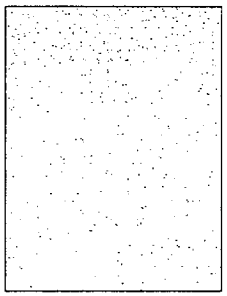
Figure 2E:
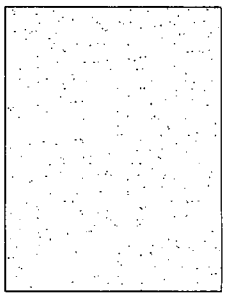

The water in the tank is heated in the following manner. Water proximate to the applicable heating element(s) (e.g., heat exchanger or electric heating element) is heated via direct contact with the element. This is substantially a purely conductive heat transfer. In turn, the heat in the heated water proximate to the heating element(s) is transferred, primarily via conduction, to other portions of the water in the tank. Since water has a relatively high coefficient of conduction $K_{H2O}$, the heat transfer is fairly good. Thus, under a steady state condition, the temperature of the water in the tank is somewhat even, as shown in FIG. 2*a*, wherein the density of the particles represent the relative temperature of the water.

In addition to heat being added to the water in tank 104 by heater 106, heat transfer losses occur through the tank walls (i.e., sidewalls, base, and top). This heat transfer is generally related to the amount of insulation in the tank walls, and the temperature differential between the water in the tank and the air surrounding the tank. For simplicity, this rate of heat loss is modeled as $$\dot{q}_{out} = \frac{K_T A \Delta T}{L} \qquad \text{equation (1)}$$

wherein $K_T$ represents an effective coefficient of thermal conduction through the tank wall, A is the area of the tank wall, L is the thickness of the tank wall, and $\Delta T$ is the temperature differential. In general, $\dot{Q}_{in}$, the rate of heat transfer into the tank via heater 106, is much greater than $\dot{q}_{out}$.

The cold water entering the tank has a pressure of $P_1$. This creates a water pressure in tank 106 that is also substantially $P_1$. As a result, when a valve downstream from the hot water tank output 112 is opened, the pressure differential across the value causes hot water to exit the tank. At the exit point, the pressure of the hot water $P_2$ is substantially equal to the cold water pressure $P_1$. At the same time, the mass flow rate $\dot{M}$ of the water entering through the cold water inlet and exiting via the hot water outlet is substantially equal.

As cold water enters tank 104, it immediately mixes with the water in the tank, reducing that temperature of the water at the bottom of the tank. At the same time, this colder water comes into contact with the heating element(s), causing the water to be heated. Meanwhile, entry of the cold water pushes out the hot water occupying the top of the tank. This water enters the hot water outlet 112 and passes through the hot water line to the valve that is opened.

On first glance, one might think that the temperature of water throughout the tank would be gradually reduced in response to the inflow of cold water. However, as illustrated in FIGS. 2*a*-2*e*, wherein water temperature is represented by the density of the hatch elements, this is not the case. Rather, a substantial "plug-flow" condition exists, wherein only a limited amount of mixing occurs. Another characteristic supporting the plug flow condition is the fact that colder water is denser than warmer water, causing the colder water to fall to the bottom of the tank.

FIGS. 3*a* and 3*b* are generally reflective of the temperature vs. time characteristics of the water leaving a hot water tank under steady flow conditions. As illustrated by each curve, the water temperature gradually decreases at a fairly constant rate, followed by a rapid fall off when the cold water nears the top of the tank. The rate of the fall off and timescale will be dependent on several parameters, including the mass flow rate $\dot{M}$, the volume of the tank, the heat input rate into the tank $\dot{Q}_{in}$ and the heat loss rate through the tank $\dot{q}_{out}$ . . . . In addition, the heat input and heat loss rates may change over time, due to effects such as oxidation of the heating element or heat exchanger, a reduction in gas burner efficiency, etc.

Returning to the problem at hand, under a typical shower scenario a person turns on the shower faucet to a known setting, and waits a short time before testing the water with his or her hand to ensure the shower temperature is good. For illustrative purposes, the temperature of an exemplary shower 114 is controlled by a cold water valve 116 and a hot water valve 118, with the flow rates for each of cold water flowing through a cold water pipe 102A and hot water flowing through a hot water pipe 112A mixing to formed shower water exiting a shower head 120. It will be recognized that a single valve that simultaneously controls the flow rates of both cold water 102 and hot water 112 may also be used.

Since most people aren't human thermometers, the starting temperature range for a given shower may vary a few degrees without being noticeable. This change of temperature for a known faucet setting is generally the result of the hot water tank temperature being different for different showerings. What the user doesn't know is that the hot water tank temperature may have been reduced due to recent hot water consumption of unknown quantity.

Some embodiments of the invention address this problem by projecting the hot water temperature over time based on modeling the heat transfer characteristic of the water heater. In one embodiment employing an "observation" model, the temperature of the hot water leaving the hot water tank is projected into the future based on previously-observed temperature vs. flowrate and time characteristics, thereby providing a prediction when inadequate hot water will become available to continue a comfortable shower.

Figure 4:
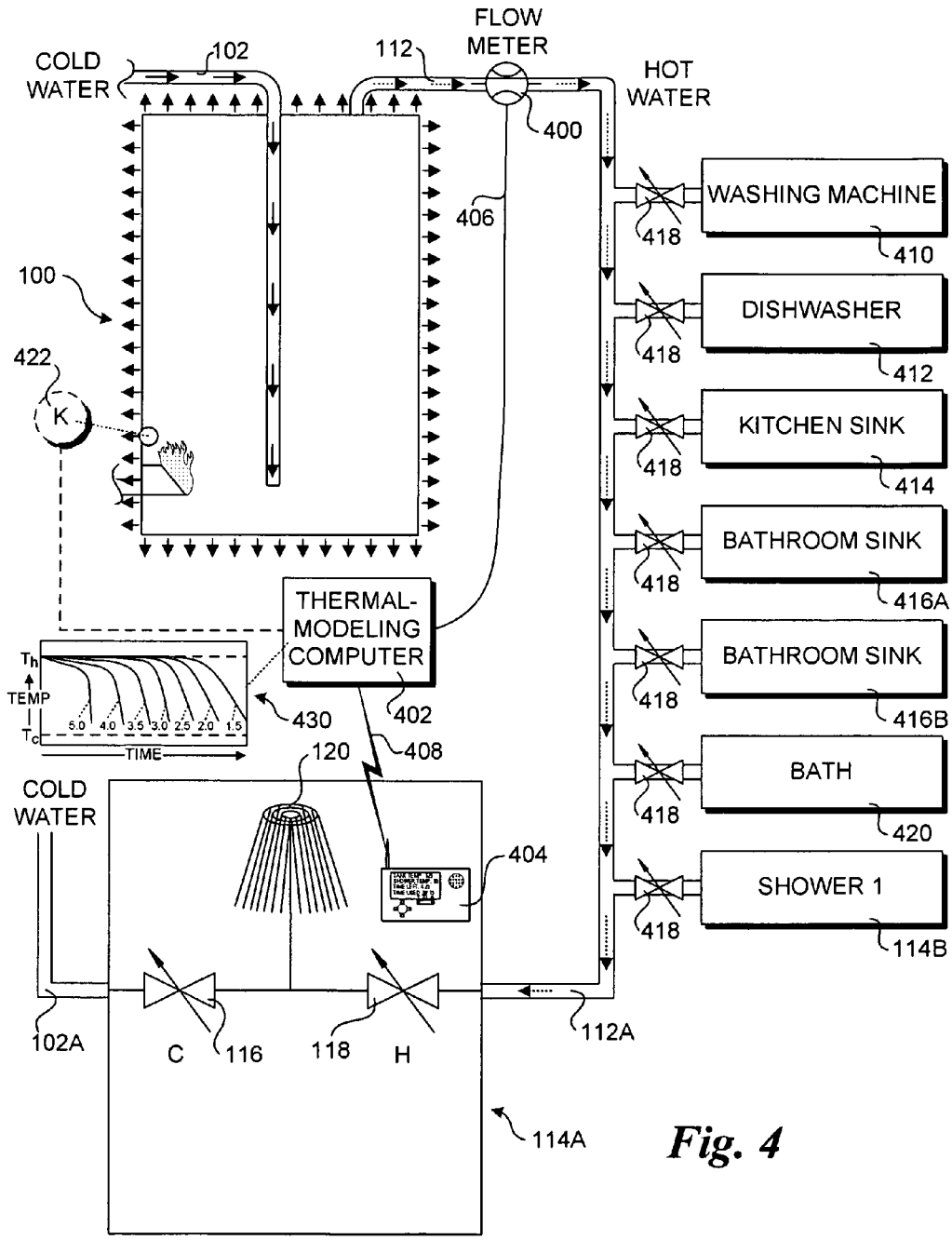
FIG. 4 is a schematic diagram illustrating components of one embodiment of the invention that employs a volumetric flow meter.

One embodiment that employs an observation model is shown in FIG. 4. The embodiment provides a volumetric flow meter 400. Volumetric flow meters are used to measure the volumetric flow rate of liquids, such as water. For practical purposes, a volumetric flow meter functions as a mass flow meter over the operating water temperature range commonly associated with water heaters. Accordingly, in this embodiment volumetric flow meter 400 functions as a mass flow meter.

In addition to volumetric flow meter 400, the embodiment of FIG. 4 includes a thermal-modeling computer 402 and a control/monitor interface 404. In general, the thermal-modeling computer may be co-located with the flow meter, co-located with the control/monitor interface, or separately located. The control/monitor interface 404 will typically be located inside or proximate to the outside of a shower, although it may be located anywhere in a house or building. Signals between volumetric flow meter 400, thermal-modeling computer 402, and control/monitor interface 404 may be transmitted by wires or cabling, via wireless transmission means, or a combination of the two. In the illustrated embodiment, thermal-modeling computer is linked in communication with volumetric flow meter 400 by a cable 406, and is linked in communication with control/monitor interface 404 via a wireless signal 408.

In general, thermal-modeling computer 402 is programmed to project temperature profiles in response to observed water flow rates as measured by volumetric flow meter 400. The temperature-projection mechanism can be implemented by one of several means.

In one embodiment, a heat transfer temperature model is employed. Under the model, the temperature of the hot water exiting hot water outlet 112 is projected by integrating a hot transfer model corresponding to the heat transfer characteristics of the hot water tank. In one embodiment, the model is qualitative—that is, it is a model that is based on parameters provided by the hot water tank manufacturer or a third party who has measured or modeled the heat transfer characteristics of the hot water tank. Thus, in this model, the heat transfer characteristic depicted in FIG. 1 are employed, wherein the temperature of the water exiting the hot water tank is projected on an energy balance in accordance with the second law of thermodynamics. Under the energy balance model, the temperature of the water is a function of the several parameters, including the heat transfer input, the volume of the tank. In qualitative terms, $$\Delta T_{H_2O} = \frac{\text{NET HEAT LOSS} \times c_p}{M_{TANK}} \qquad \text{equation (2)}$$

where $c_p$ is the specific heat of water, and $$\text{NET HEAT LOSS} = \int \dot{Q}_{in} - \dot{Q}_{out} - \dot{q}_{out} \qquad \text{equation (3)}$$

where, $$\dot{Q}_{out} = M(T_2 - T_1)c_p \qquad \text{equation (4).}$$

In general, the foregoing energy balance equations can be integrated over time to project the temperature of the water in the tank. In addition, equations indicative of plug flow characteristics may be added to the energy balance equations to project the exiting hot water temperature. To enhance accuracy, one or more temperature measurement devices, such as thermocouples, RTD (resistive thermal devices), etc., may be used to improve the temperature projection mechanism.

Under a typical installation, hot water from a hot water tank 100 will be used to provide hot water to several hot water "consumers;" exemplary hot water consumers shown in FIG. 4 include a washing machine 410, dishwasher 412, kitchen sink 414, bathroom sinks 416A and 416B, a bath 420, a first shower 114A and a second shower 114B. Each of the hot water consumers is connected to hot water pipe 112A via a respective hot water valve 418. For simplicity, corresponding cold water valves are not shown, although they will exist for most types of hot water consumers except for most dishwashers.

The embodiment of FIG. 4, as well as the other embodiments described herein, is able to forecast when a hot water tank will run out of hot water under various flow conditions. For example, in addition to consuming water in shower 114A, hot water may be concurrently consumed by one or more other hot water consumers. From the general perspective of volumetric flow meter 400 and hot water tank 100, the particular water consumer(s) is immaterial. Some hot water consumer is consuming hot water at some flow rate. This rate can be measured over time by volumetric flow meter 400 and integrated by thermal-modeling computer 402.

In some embodiments, the projected time remaining until an inadequate hot water supply will exist is based on currently-observed conditions. This may produce an inaccurate projection, although the error will generally be on the conservative side. The reason for this is that the projection presumes a steady-state condition. While steady-state conditions are common for baths and showers, they are not common for other types of hot water consumers. For example, a washing machine will consume hot water while it is filling, and may use hot water during some rinse cycles. The amount of hot water consumed will usually depend on the water temperature selected. However, the rate of hot water consumption will generally be independent of the temperature selected, since solenoid (i.e., on-off) flow values are generally contained inside of a washing machine to control hot and cold water supplies to the machine. A similar situation exists for dishwashers (i.e., use of an on-off flow valve), although there may be dishwashers that have both hot and cold water inputs.

The net result of the foregoing characteristic is that when a washing machine is filling with hot water or performing a hot water rinse cycle, it may appear that the currently-observed hot water consumption is very high, especially when a shower is concurrently being used. However, it is unusual for this hot water consumption rate to be maintained throughout a shower, as a washing machine fills fairly quickly.

Thus, it would be advantageous to know what type of hot water consumer is consuming hot water. For instance, washing machine and dishwasher hot water consumption cycles are very repeatable. Accordingly, the modified embodiment of FIG. 4*a* further includes one or more flow valves 418A with respective built-in sensors that are coupled in communication with thermal-modeling computer 402. Optionally, separate on-off type flow sensors may be used in place of built-in sensors. Under the embodiment of FIG. 4*a*, a respective flow sensor can be used to inform thermal-modeling computer 402 that hot water is being consumed by a particular hot water consumer. For example, activation of a flow sensor for washing machine 410 may be used to inform thermal-modeling computer 402 that a washing machine cycle has started. From previous knowledge (either via a pre-programmed model or an observation model), the amount of hot water consumed during the cycle can be known and considered in projecting an amount of hot water remaining in water heater 100.

Typically, the hot water consumed by someone at a kitchen sink 414 or bathroom sink 416 will be fairly intermittent. However, the currently-observed hot water consumption rate may be fairly high, especially if someone turns the hot water faucet on all of the way to clear cold water from a hot water pipe. This, again, may produce an inaccurate forecast. Under this circumstance, the hot-water usage may be integrated in the hot water temperature model, while the intermittent usage may be ignored for when determining the amount of time remaining until an adequate hot water supply for a shower is projected to run out.

Under many situations, concurrent use of a shower and another hot water consumer will cause the temperature of the water in the shower to drop (by lowering the water pressure, and thus flow rate into the hot water flow valve 118 of the shower). However, in many modern shower installations, this condition is automatically counteracted by a pressure-balanced valve, which continuously adjusts the flow rates of both the hot and cold water inflows to maintain a constant shower temperature. In this instance, both the hot and cold water flow rates will be reduced by the loss of pressure in the hot water supply line. This reduction in flow rate will also be detected by the volumetric flow meter 400, and thus accounted for by temperature-modeler computer 402.

In another embodiment, the temperature of the exiting hot water is projected by a combination of volumetric flow integration in combination with pre-defined thermal model performance profiles. For example, the temperature vs. time at flow rate profiles of FIGS. 3*a* and 3*b* may be programmed as mathematical functions or stored in the form of lookup tables or the like. Based on observation of the volumetric flow rate of the exiting hot water over time, a point on a corresponding curve can be calculated. Based on the point on the curve, the time until the temperature falls below a given threshold temperature can be projected. If desired, curve interpolation may also be employed. Data corresponding to this projected time can then be transmitted to control/monitor interface 404. In addition, the use of thermocouples and the like may also be used to enhance accuracy. This is especially useful for establishing baseline conditions.

Figure 4A:
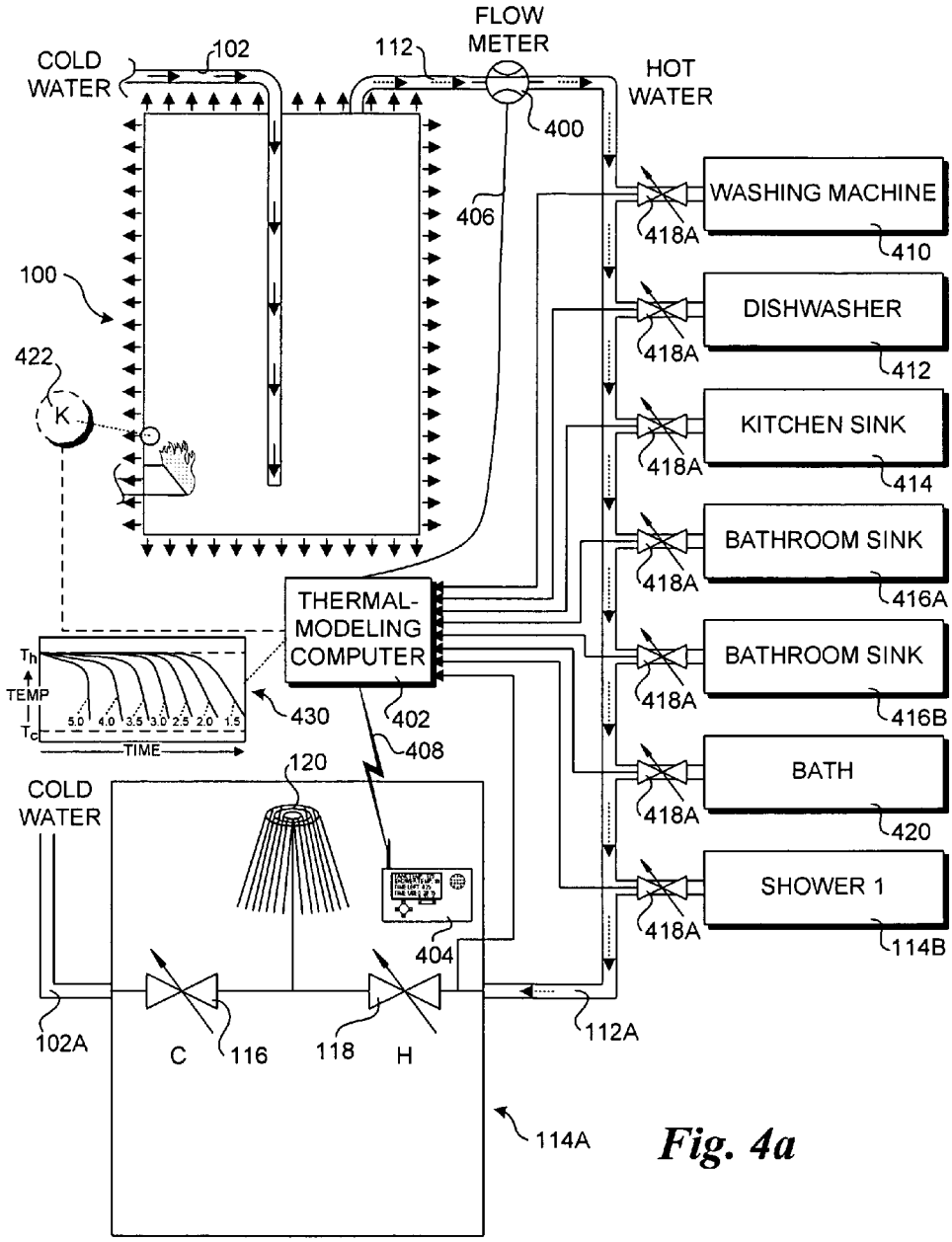
FIG. 4*a* is a schematic diagram illustrating a variant of the embodiment of FIG. 4 that further includes one or more flow sensors.

As shown in FIGS. 4 and 4*a*, an optional temperature sensor 422 may also be employed by temperature-modeler computer 402. In one embodiment, temperature sensor 422 may be used to determine an initial condition for water heater 100. For example, by knowing the temperature of the hot water in a hot water tank, a thermal model may be initialized or an initial point on a curve can be obtained. In one embodiment, temperature sensor 422 may be used to augment or correct the projected hot water availability.

Figure 5:
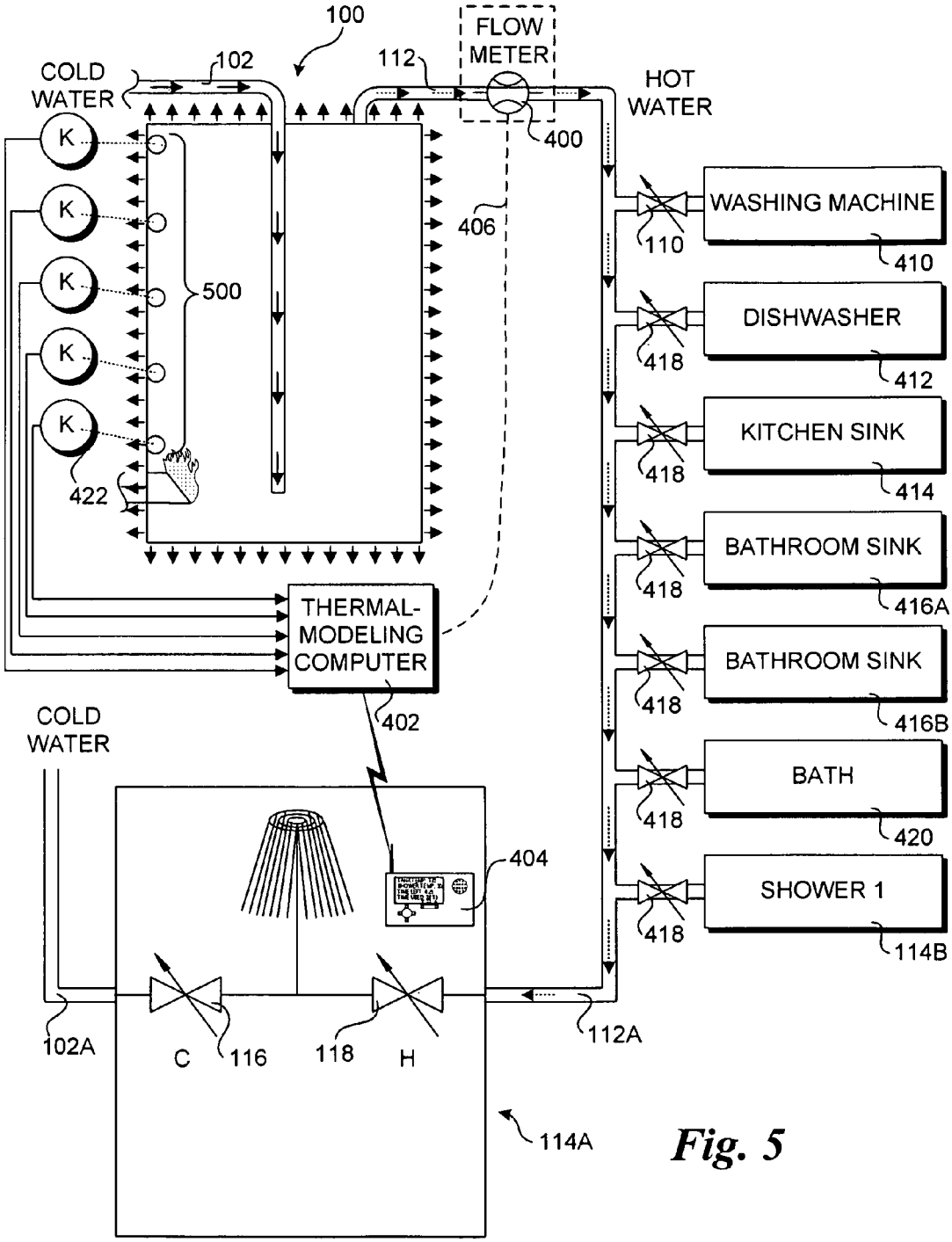
FIG. 5 is a schematic diagram illustrating components of one embodiment of the invention that employs a plurality of temperature sensors.

In accordance with another embodiment shown in FIG. 5, a plurality of temperature sensors 422 are coupled to various points along the wall of tank 104 (or otherwise disposed on the inside of the tank at fixed locations). In general, temperature sensors 422 may be located internally within a hot water tank (e.g., along the inner wall or offset therefrom), or externally (e.g., along the outer wall). Any suitable type of temperature sensor may be used. This includes, but is not limited to resistive thermal devices (RTDs), thermocouples, acoustic transducers, and infrared transducers.

In one embodiment, the temperature sensors 422 are spaced at even vertical intervals along a tank wall. The number of sensors employed will generally depend on the particular implementation. In general, more temperature sensors will lead to higher accuracy, as long as the sensors are properly calibrated. However, additional sensors will increase the cost of the implementation.

As the temperature of the water changes in response to hot water consumption, the output of each temperature sensor changes. By observing the rate of change and/or the measured water temperatures, the point in time at which the exiting hot water temperature falls below a threshold temperature can be projected.

In one embodiment, a single elongated RTD sensor is used. In one embodiment, the elongated RTD is disposed vertically along the hot water tank wall. In general, an elongated RTD may be used to measure an average temperature within a hot water tank. By using a pre-programmed thermal model or observation-generated thermal model, an average temperature may be used to predict the temperature at the top of the hot water tank when an appropriate thermal model is employed.

As shown in FIG. 5, an optional volumetric flow meter 400 may also be employed. In general, the addition of a flow meter may be used to increase the accuracy of the temperature model. In one embodiment, aspects of the embodiments of FIGS. 4 and/or 4*a* may be combined with aspects of the embodiment of FIG. 5. For example, a combination of flow rate vs. temperature modeling may be augmented using observed temperature measurements.

According to one aspect of the invention, thermal calibration embodiments are provided that automatically adapt to the parameters of the water systems in which they are installed. For example, in one embodiment, flow rate vs. temperature curves may be determined by observing corresponding parameters in an installed system.

Figure 3:
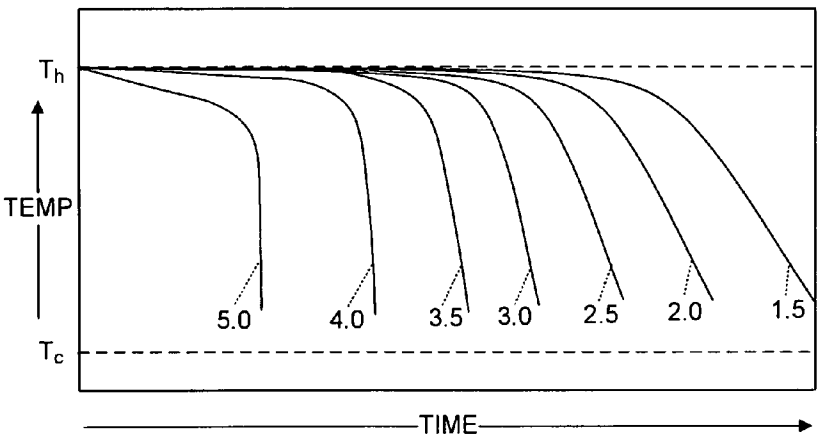
FIG. 3 is a temperature vs. time graph showing various temperature vs. time curves corresponding to different hot water flow rate conditions.
Figure 6:
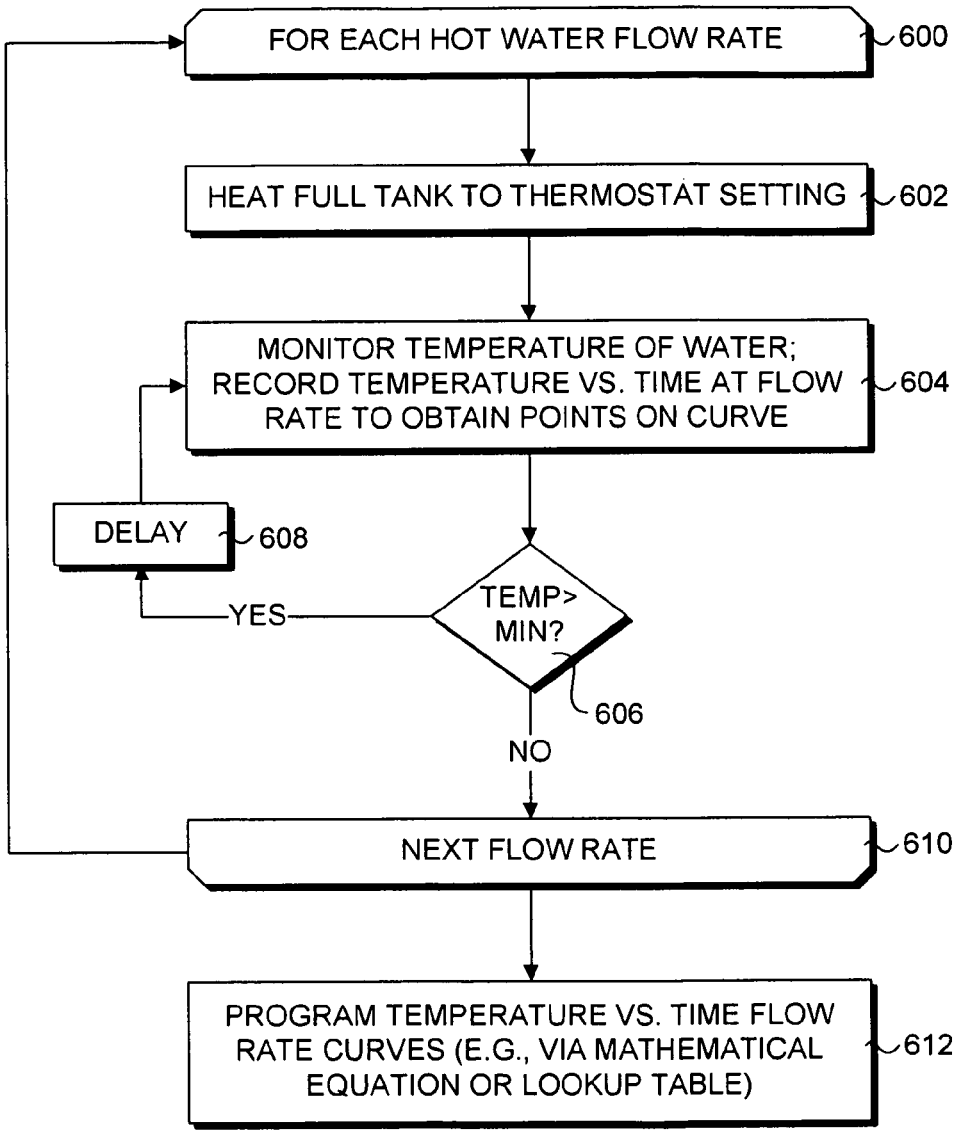
FIG. 6 is a flowchart illustrating operations used to generate a temperature model via observation of temperature and flow-rate parameters during operation of a water heater, according to one embodiment of the invention;'

Operations performed in one embodiment of an observation-based thermal calibration model are shown in FIG. 6. As depicted by start and end loop blocks 600 and 610, the process is repeated for multiple different hot water flow rates. For a given flow rate, the process begins by heating the hot water tank to its thermostat setting in a block 602. The temperature of the water exiting the tank is then monitored and recorded periodically while also recording time information to generate plot points on a temperature vs. time curve for the flow rate. These operations are collectively depicted by a block 604, a decision block 606, and a delay block 608. As illustrated by decision block 606, the measurement and recording operations are repeated until the water temperature exiting the hot water tank falls below a predetermined minimum value. Generally, the predetermined minimum value should be a little less than the lowest temperature at which a typical person would desire to take a shower. Upon reaching this point, the process is repeated for the next flow rate. After the measurements have been recorded, temperature vs. time and flow rate curves, such as shown in FIG. 3, may then be programmed via mathematical equations or look-up tables, as depicted by a block 612. These curves may generally be derived via interpolation of the plot points, as desired. It is also possible to derive curves at flow rates other than those measured using appropriate interpolation of the data using well-known techniques. An exemplary set of temperature vs. time at flow rate curves are shown in FIG. 3.

Figure 7:
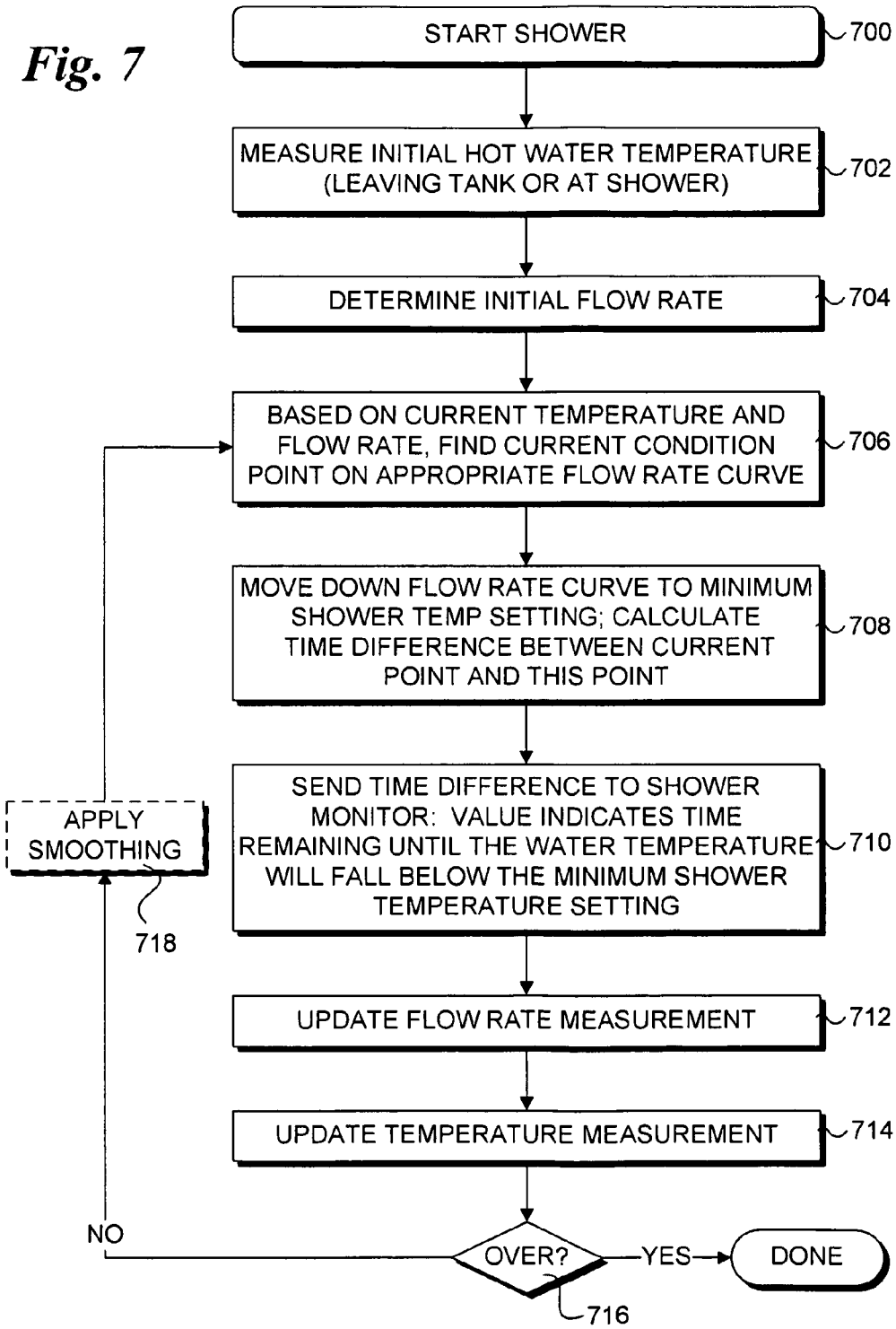
FIG. 7 is a flowchart illustrating operations performed to project an amount of time remaining before the water temperature of a shower falls below a minimum threshold, according to one embodiment of the invention.

FIG. 7 shows a flowchart illustrating operations and logic performed to project the amount of time available for a shower, according to one embodiment. This scheme is generally applicable to the embodiments of FIGS. 4 and 4*a*, but could be used in any embodiment that includes a flow rate measurement and temperature measurements.

The process begins in a start block 700 when the shower is started. In one embodiment, the flow rate leaving the hot water tank is continuously monitored, whereby starting a shower (or any water consumption event) is detected by a change in flow rate. In another embodiment, a user manually activates the shower monitor/interface, via a menu selection or verbal request.

In response to the initiation event, an initial hot water temperature measurement is made in a block 702. Depending on the implementation, the measurement may generally be made at the point the water leaves the tank, or proximate to the showerhead. As a corollary operation, an initial flow rate is determined in a block 704.

Figure 8A:
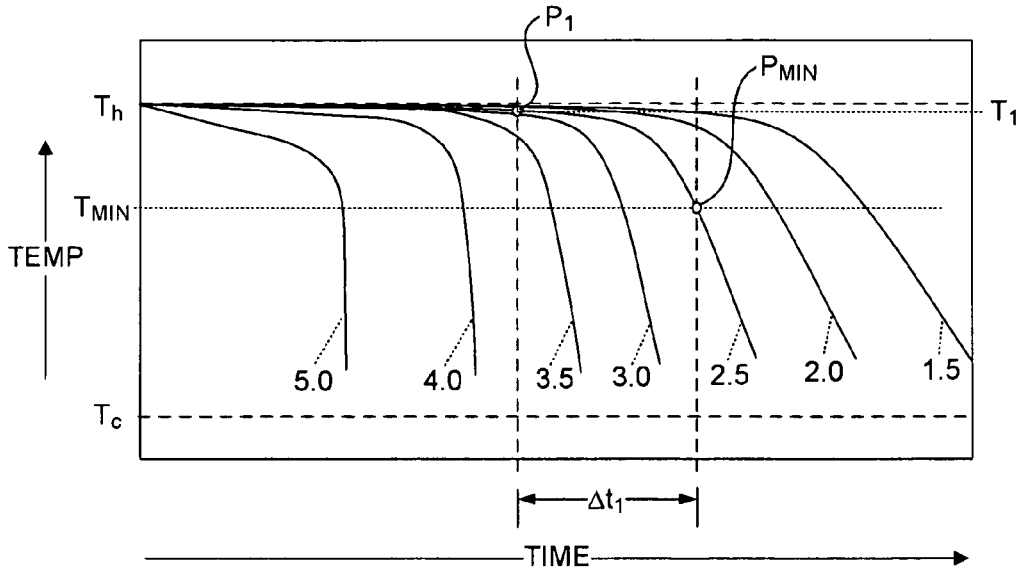
FIGS. 8*a* and 8*b* respectively show earlier and later water availability conditions corresponding to an exemplary use of the calculation technique used in the remaining time calculation embodiment of FIG. 7.

Following the operations of blocks 700, 702, and 704, the operations of the remaining blocks are repeated until the shower is finished. First, in a block 706, a current condition point is found on an appropriate flow rate curve. For example, as shown in FIG. 8*a*, suppose the initial temperature is $T_1$ and the initial flow rate is 2.5 gallons per minute (GPM). This results in the current condition point being located at point $P_1$. Next, in a block 708, one moves down the flow rate curve until the minimum shower temperature setting $T_{MIN}$ is reached, which is shown at a point $P_{MIN}$. The time difference between the current point and the minimum temperature point is then calculated. In this case, the time difference between points $P_1$ and $P_{MIN}$ is $\Delta t_1$. This value represents the amount of time that is projected before the temperature of the water exiting the hot water tank (or entering the shower, depending on where the measurement is taken) will fall below the minimum temperature setting $T_{MIN}$.

In a block 710, this time value is transmitted to the shower monitor/interface. This transmission can be via a wired communication link or a wireless link, as discussed above. Upon receiving the time value, corresponding information is displayed on the shower control/monitor interface.

The loop continues in blocks 712 and 714, wherein the flow rate and temperature measurements are updated, respectively. Then, a determination is made in decision block 716 to whether the shower is over. As above, this determination can be made by observing the flow rate. If the flow rate is dropped to zero, the shower is done. Another indicator may be a change in flow rate that is similar to the increase in flow rate detected in start block 700. This is for cases in which other hot water consumption is present at the time the shower is turned off.

If the shower is determined to be ongoing, the logic loops back to block 706 to being the next iteration of the operations of blocks 706, 708, 710, 712, and 714. As an option, a smoothing algorithm or the like can be applied in accordance with a block 718. The smoothing algorithm is used to dampen overshoots and the like in projecting time remaining values. For example, a particular temperature or flow rate reading may be sensed as a spike, due to electronic interference or the like. The spike would produce an erroneous prediction. The smoothing algorithm is used to smooth out the effect of such spikes.

Figure 8B:
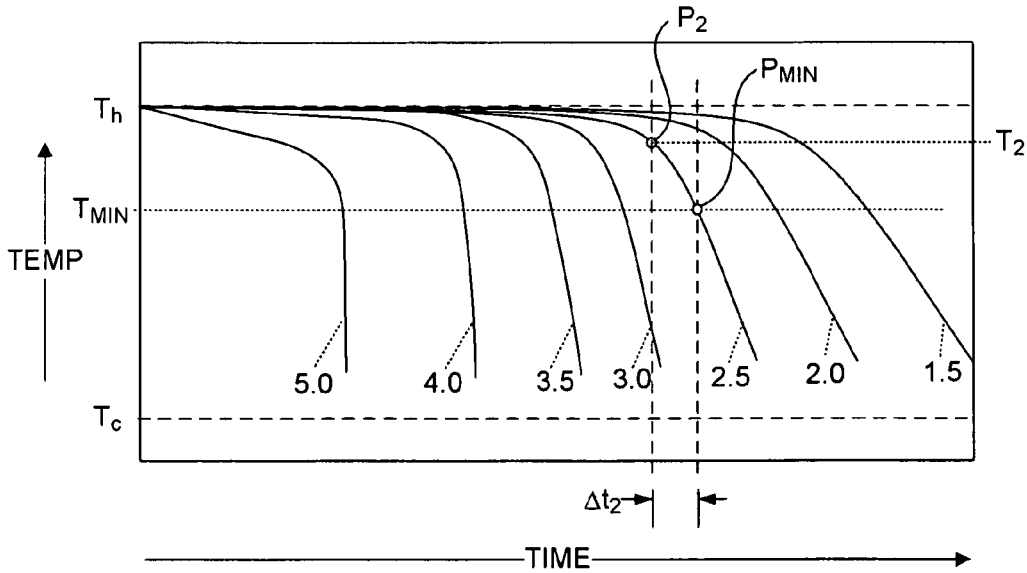

The example of FIG. 8*b* represents a later point in the shower example of FIG. 8*a*. At this point, the flow rate is still 2.5 GPM, with the temperature now being reduced to $T_2$ due to the hot water consumed by the shower. This places the current condition at point $P_2$, and the current predicted time remaining at $\Delta t_2$.

It is noted that various hot water consumers may consume hot water concurrently with the shower. Under such conditions, the flow rate will change. This will also yield a commensurate change in current flow rate curve that is to be used.

Under a more complex system, such as shown in FIG. 4*a*, there are sensors that may be employed to detect the flow rate or on-off usage of various hot water consumers, such as washing machines, dishwashers, etc. A potential advantage of this system is that certain consumption patterns may be programmed into the thermal-modeling computer. For example, a washing machine has fixed cycles that are commonly used. The washing machine may be known to consume a predetermined amount of hot water for a given cycle. In many cases, the amount of hot water is only a fraction of the size of a hot water tank.

What this does, in effect, is to consider that while a current hot water consumption rate is determined to be high, it isn't forecast to continue for a lengthy period. For example, suppose a shower and a washing machine are currently consuming hot water at some point during the shower, resulting in a current measurement of 5 GPM. The curve for 5 GPM falls off rapidly, as shown in FIGS. 3, 8*a*, and 8*b*. This would normally predict a relatively short amount of time remaining until an insufficient amount of hot water would be available to maintain the shower temperature above $T_{MIN}$, e.g., 5 minutes. However, it might be known that the washing machine only consumes hot water for 1 minute. As a result, this could be added to the thermal model, yielding a prediction that moreaccurately projecting the amount of hot water that will be available. This might yield a projecting of 8 minutes, for example.

Figure 9:
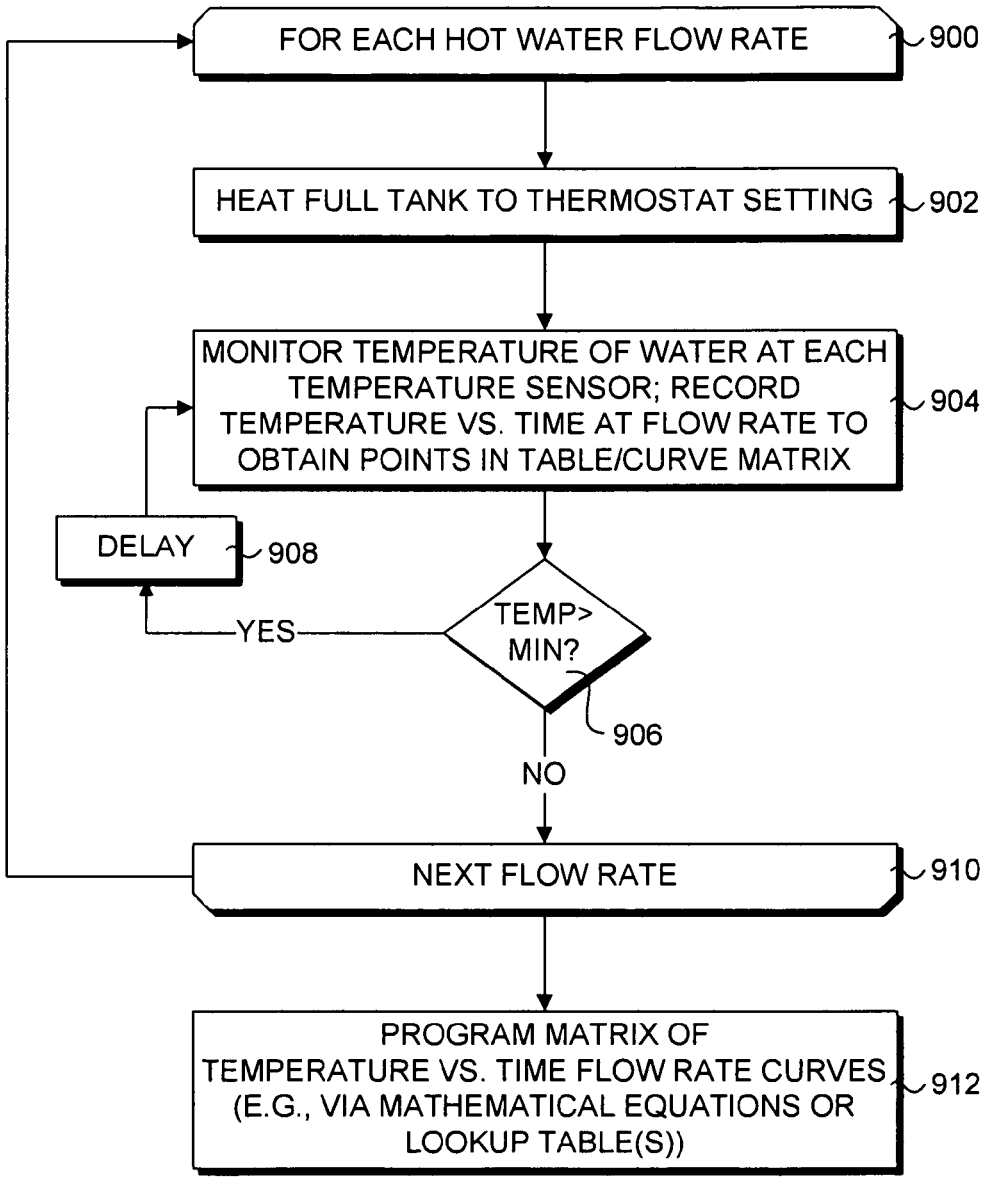
FIG. 9 is a flowchart illustrating operations used to generate a temperature model of a water heater via observation of temperature measurements at a plurality of locations in the water heater's hot water tank during operation of the water heater, according to one embodiment of the invention;'

FIG. 9 shows a flow chart illustrating operations and logic performed during thermal calibration of a water heater having a configuration similar to that shown in FIG. 5, according to one embodiment. The process is roughly analogous to the observation-based thermal calibration the operation of the embodiment of FIG. 5, has depicted by the text in blocks 900, 902, 906, 908, and 910, which are analogous to operations in blocks 600, 602, 606, 608, and 610 in FIG. 6. However, in the embodiment of FIG. 9, data is recorded for multiple temperature sensors.

In one embodiment, data is recorded for each temperature sensor location in block 904 in a manner analogous to that used for the single temperature sensor employed in the FIG. 6 thermal calibration embodiment. That is, separate thermal performance curves (e.g., such as shown in FIG. 3) are derived for each sensor location. At the completion of the data-gathering operations, corresponding equations are derived or lookup tables are built in a block 912.

In another embodiment, data points obtained in block 904 are grouped for each set of temperature sensors in a table or curve matrix. Under this technique, the sensed temperatures of the water at a set of locations is recorded for each respective data point sets, effectively taking a temperature-distribution "snapshot" at each point in time. In one embodiment, these snapshots are digitally-stored in a lookup table in a block 912.

Through comparing exit temperatures with the snapshots at different flow rates, current water heater tank conditions can be determined. For example, suppose that a hot water tank is half full of hot water. Depending on the rate of water consumption prior to a measurement, the temperature distribution within the tank may differ. By storing snapshots, an initial condition of the water heater tank can be established.

In one embodiment, the operations of the thermal calibration techniques of FIGS. 6 and/or FIG. 9 may be ongoing. That is, the system may be configured or otherwise programmed to continuously update its calibration curves and/or tabulated data. Furthermore, in one embodiment of the thermal calibration technique of FIG. 9, the hot water flow does not need to be specifically known (e.g., provided by a flowmeter). By performing thermal calibrations at various rates, data corresponding to projected flow rates can be stored along with the calibration data. During shower operations, these flow rates can be derived by performing reverse table lookups, or by using similar techniques with the mathematical thermal modeling equations.

Figure 10:
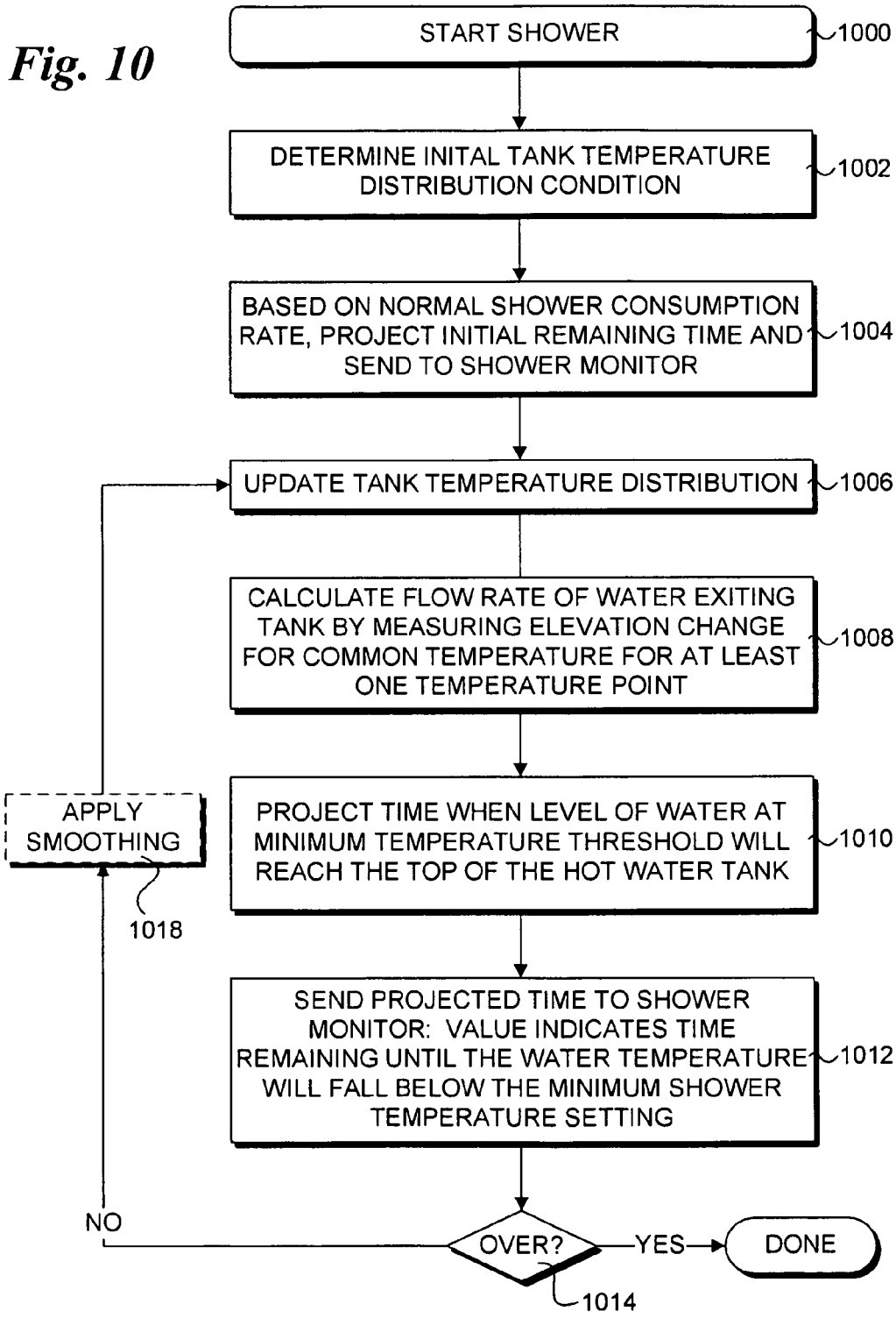
FIG. 10 is a flowchart illustrating operations performed to project an amount of time remaining before the water temperature of a shower falls below a minimum threshold, according to one embodiment of the invention.

FIG. 10 shows a flowchart illustrating operations and logic performed to project the amount of time available for a shower, which is generally applicable to the embodiments of FIGS. 5 and 9. One notable advantage of this embodiment is that no flow rate measurement is required. Accordingly, the remaining operations discussed below are performed in consideration that a flowmeter is not used. It is noted, however, that a flowmeter may be used to augment the following operations, if desired.

The process begins in a block 1000 with the start of the shower. This can be determined in a manner similar to that discussed above in block 700 of FIG. 7. If a flowmeter isn't used, the start of the shower can be detected by a small change in temperature at a lower temperature sensor (indicating cold water is flowing into the hot water tank) or via some other means, such as a flow switch or user-activated startup. In one embodiment, the start of a shower is detected by "hearing" the water in the shower, as described below in further detail.

Figure 11A:
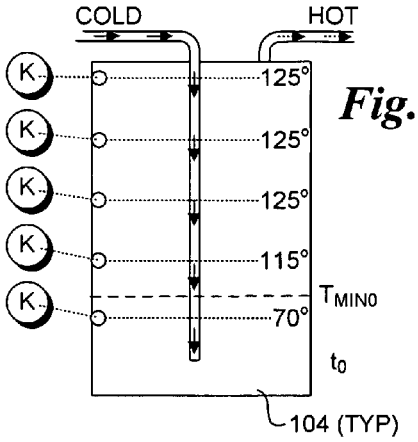
FIGS. 11*a-f* are schematic diagrams that respectively show temperature distributions in a hot water tank over time while hot water is being consumed, draining hot water from the tank.

Continuing with the flowchart of FIG. 10, in a block 1002 an initial tank temperature distribution condition is detected by measuring current temperatures at various locations in the tank. An exemplary initial condition is shown in FIG. 11*a*. In one embodiment, this operation determines a water level in the hot water tank at which the water temperature is the minimum temperature threshold, $T_{MIN}$. For this example, $T_{MIN}$ is set to 90° F. The corresponding water level is depicted as $T_{MIN0}$, wherein the "0" indicates an initial time $t_0$. The water level for $T_{MIN}$ may typically be determined by interpolating the temperature measured at the various vertical locations in the hot water tank for situations under which $T_{MIN}$ is not measured at a single location.

In a block 1004, an initial projection of how much time is remaining for a shower using a "normal" shower hot water consumption rate is made. For example, most people use the same shower settings, and thus the hot water consumption rate for most people is somewhat constant and repeatable. Furthermore, most of today's showerheads (or other plumbing devices) limit a shower's flow rate to 2.5 GPM. It is noted that people shower at a temperature lower than the typical thermostat setting for a hot water heater, so the actual hot water flow rate will typically be about 2 GPM or less at the beginning of a shower. By "guessing" this initial flow rate, an initial projection is made in block 1004, with the projection displayed on the shower monitor (or otherwise provided to the showerer).

Figure 11B:
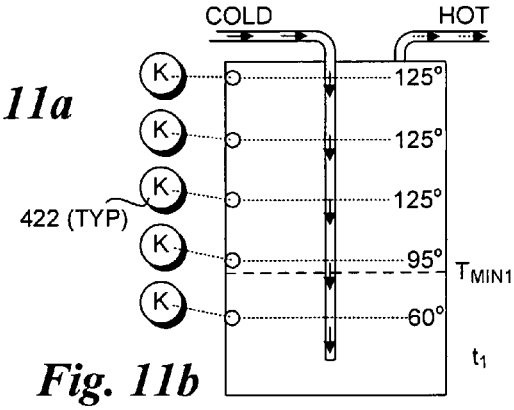
Figure 11C:
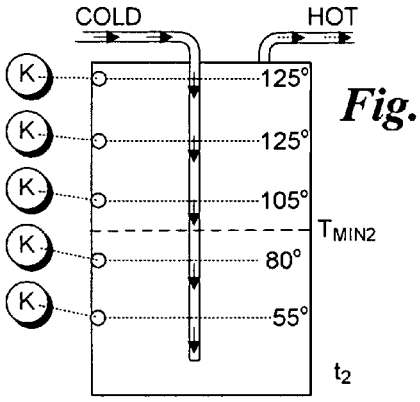
Figure 11D:
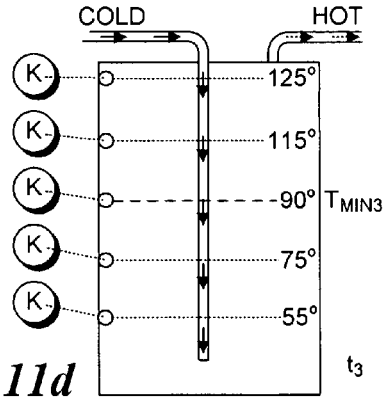
Figure 11E:
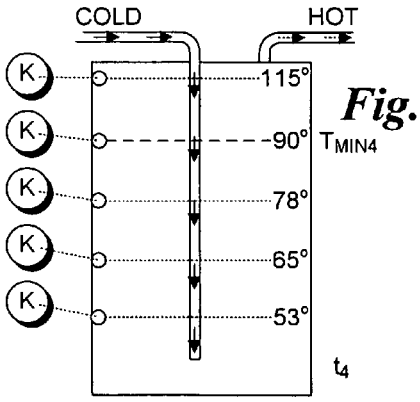

The remaining operations are performed in an interative loop, beginning in a block 1006, in which the hot water tank temperature distribution is updated. This establishes a change in condition from a previous measurement (e.g., the initial measurements made in block 1002 for the first time through the loop). For illustrative purposed, an exemplary second condition is shown in FIG. 11*b*. (It is noted that the relative change between FIGS. 11*a* and *b* are greatly exaggerated for clarity.) It is noted that the water level for $T_{MIN1}$ is higher in FIG. 11*b* (i.e., at time $t_1$) than it was in FIG. 11*b* ($T_{MIN0}$) at time $t_0$.

Based on this water level differential (i.e., the difference between water levels $T_{MIN1}$ and $T_{MIN0}$), a flow rate of water exiting the tank is determined in a block 1008. In addition to or in place of the $T_{MIN}$ temperature, one or more other temperatures may be used to enhance accuracy of the flow rate. Based on knowledge of the depth of the temperature sensors 422 and the diameter of the hot water tank 104, the flow rate can be determined by observing the vertical change in the $T_{MIN}$ water level over a pre-determined time interval (e.g., seconds).

Next, a time at which the $T_{MIN0}$) water level is projected to reach the top of hot water tank 104 is determined. This corresponds to the remaining time in the shower. In one embodiment, this measurement may be made on "linear" thermal behavior of the hot water tank. However, the temperature distribution in the hot water tank is generally somewhat nonlinear, depending on the flow rate. Accordingly, in one embodiment the time projection measurement considers nonlinear factors via use of the tabular data or equations generated above in block 912. The projected time is then sent to the shower monitor in a block 1012, whereupon it is displayed or otherwise provided to the showerer.

As before, a determination is made in a decision block 1014 to whether the shower is over. If it is not, the logic loops back to block 1006 to perform the next iteration. In one embodiment, a smoothing algorithm may be applied in a block 1018 to compensate for sensor measurement spikes. In one embodiment, multiple measurements are taken and averaged for each iteration.

Figure 11F:
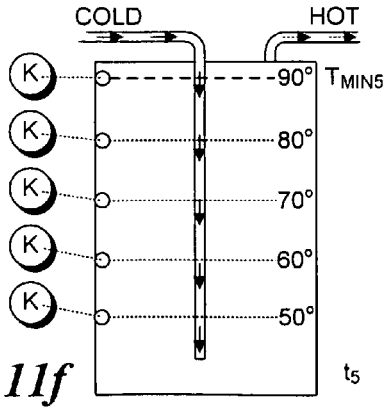

FIGS. 11*c-f* respectively show hot water tank 104 temperature distribution conditions corresponding to subsequent times $t_2$, $t_3$, $t_4$, and $t_5$, respectively. As is readily recognized, as the shower continues, the height at the water level at $T_{MIN}$ continues to increase. Depending on the flow rate of the hot water exiting the tank (corresponding to all hot water consumption), the detected rate of consumption will change, resulting in a commensurate change in the project amount of time remaining. Eventually, the water level having a temperature at $T_{MIN}$ will reach the top of the tank, as illustrated in FIG. 11*f*. Shortly after this point (in consideration of water traveling through the plumbing to the showerhead), the temperature of the shower water will fall below the minimum temperature threshold, even if the cold water flow is turned off completely. As might be expected, as the $T_{MIN}$ water level gets closer to the top, the accuracy of the projected amount of time remaining for the shower increases, since any non-linearities in the thermal behavior of the water heater are minimized at this juncture.

Figure 12:
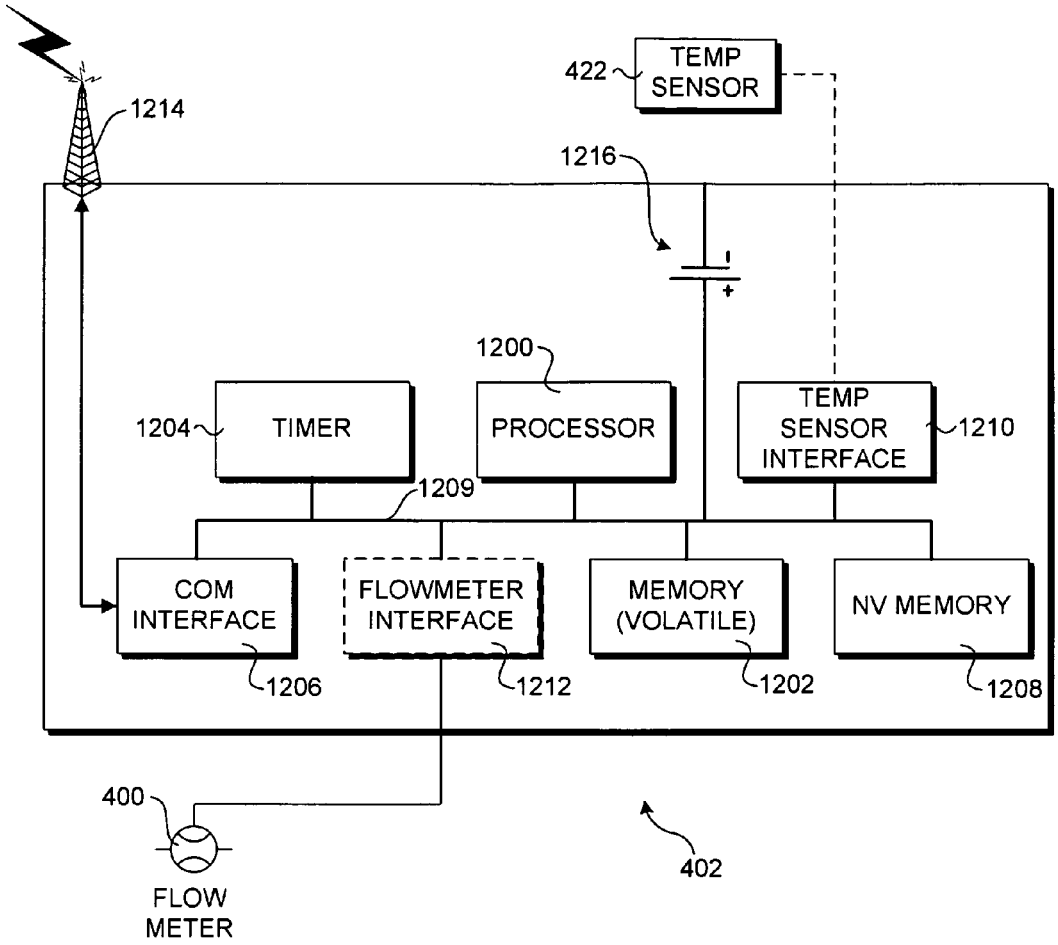
FIG. 12 is a schematic drawing circuitry for a thermal-modeling computer, according to one embodiment of the invention.

Circuit details of one embodiment a thermal-modeling computer 402 are shown in FIG. 12. The circuit configuration includes a processor 1200 coupled to (volatile) memory 1202, timer 1204, a communication interface 1206, and non-volatile (NV) memory 1208 via a bus 1209. In one embodiment, NV memory comprises read-only memory (ROM). In another embodiment, NV memory 1208 comprise rewritable NV memory such as a flash memory device. In general, processor 1200, memory 1202, and NV memory 1208 may comprise separate components, or may be combined on two or even a single component. For example, various micro-controllers integrate processor, memory, and/or ROM functionality on a single integrated circuit.

In addition, thermal-modeling computer 402 includes one or more sensor interfaces. In FIG. 12, these include a temperature sensor interface 1210 and a flowmeter interface 1212. In embodiments in which a flowmeter is not required, flowmeter interface 1212 may not be present. In embodiments in which multiple temperature sensors are employed (e.g., the embodiment of FIG. 5), temperature sensor interface may comprise respective interfaces, or may be multiplexed to receive signals from a plurality of temperature sensors 422.

In general, instructions for performing thermal modeling operations, including thermal calibration and shower runtime operations, will be stored in NV memory 1208. However, it is possible that these instructions may be downloaded from a network or other linked storage means via communication interface 1206. Similarly, data comprising the aforementioned lookup tables and/or mathematical equations used for thermal modeling will typically be stored in NV memory 1208, or may be downloaded from a network or other linked storage means.

In some embodiments, thermal-modeling computer 402 is enabled to automatically calibrate thermal performance of a hot water tank in the manners discussed above. In such instances, the calibrated thermal-modeling data (e.g., lookup tables and/or thermal equations) will be written to a rewritable NV store, such as a flash device or the like.

Communication interface 1206 is used to enable communication with remote components, such as control/monitor interface 404. In general, communications may be sent via a wired, optical, or wireless transport. As shown in FIG. 12*a*, communication interface 1206 is coupled to a wireless antenna 1214. The particular frequency used by a corresponding radio frequency (RF) signal will depend on the particular implementation. For example, a communication frequency in a non-licensed band, such as 900 Megahertz or 2.3 Gigahertz may be used. Other frequencies may be used, as well.

In one embodiment, communication interface 1206 is configured to support a network communication link, such as an Ethernet link. In this case, communication interface 1206 may comprises a network interface (e.g., Ethernet) and provide a corresponding connection (e.g., RJ-45 jack). In one embodiment, communication interface 1206 supports a serial or universal serial bus (USB) link. In still other embodiments, communication interface 1206 is configured to support a proprietary wired or optical communication link.

Under a typical configuration, the various circuit components of thermal-modeling computer 402 will be powered by a battery 1216. Optionally, an electrical-based power supply (not shown) may be used. In either case, appropriate power conditioning circuitry and routing (e.g., power planes and the like) will also be used (not shown for clarity).

Figure 13A:
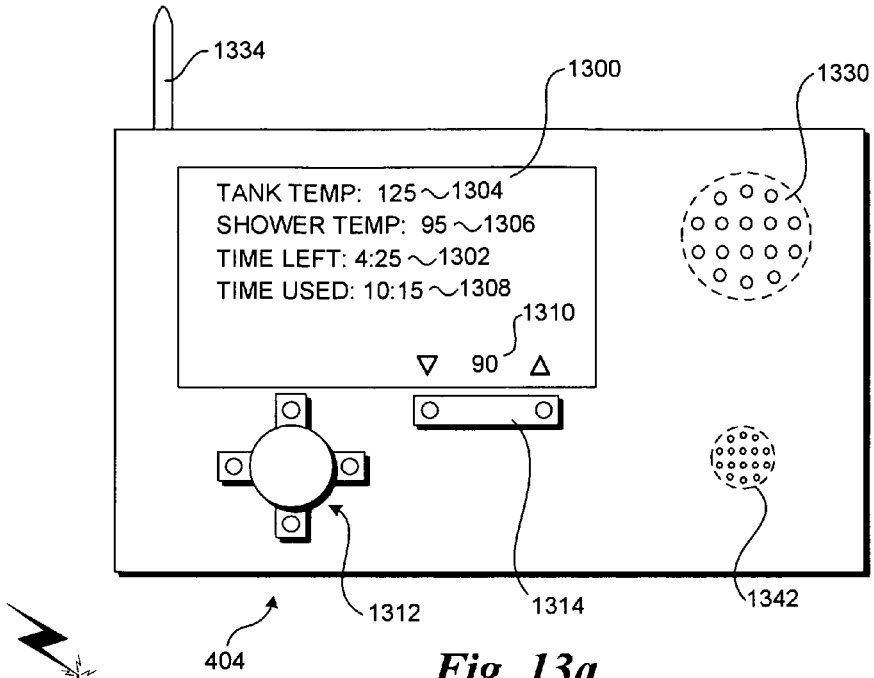
FIGS. 13*a* and 13*b* respectively show an external and internal configuration of a control/monitor interface, according to one embodiment of the invention.
Figure 13B:
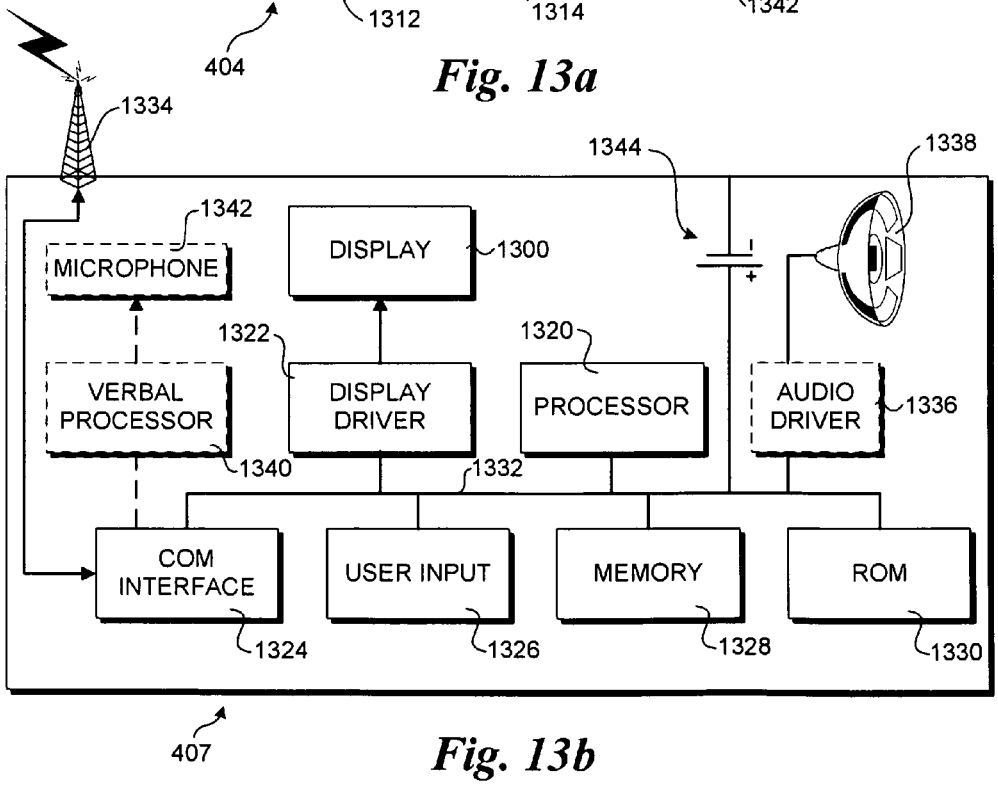

Details of external and internal aspects of one embodiment of control/monitor interface 404 are shown in FIGS. 13A and 13B, respectively. In general, control/monitor interface provides user interface functionality temperature modeling functionality. As discussed above, the temperature modeling functionality may be used by another component remotely located from control/monitor interface 404.

Control/monitor interface 404 includes a display 1300 via which various information may be displayed. In general, display 1300 may comprise any type of display suitable for an installation in a humid environment. In one embodiment, display 1300 comprises a liquid crystal display. Typically, the information displayed on display 1300 will include the amount of time remaining 1302 for which adequate hot water is forecast. In other words, time remaining 1302 will identify how much time is remaining before the shower temperature will fall below a threshold temperature. In one embodiment, the threshold temperature comprises a default value. In another embodiment, a user may enter or otherwise select the threshold temperature.

FIG. 13*a* depicts some exemplary information that may also be displayed in addition to time remaining 1302. These include a hot water tank temperature 1304, a shower water temperature 1306, and a time used 1308. Other types of information may also be displayed, including information related to user inputs, such as depicted by a threshold temperature 1310.

User input may be used for various purposes. To support user input, one of several well-known user interface mechanisms may be used. This includes, but is not limited to, keypads (e.g., alphanumeric), toggle buttons, navigation buttons/controls, touchscreens, tactile buttons, and solid-state (e.g., capacitive, resistive, etc.) buttons. FIG. 13*a* illustrates a navigation control 1312 and a toggle button 1314.

FIG. 13*b* shows details on an exemplary internal configuration for control/monitor interface 404. The configuration includes a processor 1320 coupled to a display driver 1322, a communication interface 1324, a user input interface 1326, memory 1328, and ROM 1330 via a bus 1332. In general, processor 1320, memory 1328, and ROM 1330 may comprise separate components, or may be combined on two or a single component. For example, various micro-controllers integrate processor, memory, and/or ROM functionality on a single integrated circuit.

Display driver 1322 is used to control the information on display 1300. User input interface 1326 is used to receive and process user input entered via corresponding user input components, such as navigation control 1312 and toggle button 1314.

Communication interface 1324 is used to enable communication with remote components, such as thermal-modeling computer 402. In general, communications may be sent via a wired, optical, or wireless transport, wherein the communication means between thermal-modeling computer 402 and control/monitor interface 404 will be the same. As shown in FIG. 13*a*, communication interface 1324 is coupled to a wireless antenna 1334 to support a wireless communication link.

In one embodiment, control/monitor interface 404 provides audio information or warnings, such as "your hot water will run out in one minute." Accordingly, an audio driver 1336 and speaker 1338 are provided in this embodiment.

In one embodiment, a verbal user interface is supported. Under this embodiment, a user can set various parameters via spoken words. A verbal processor 1340 and microphone 1342 are provided to support this embodiment. In one embodiment, the verbal use interface may be used to automatically detect when a shower is running by "hearing" the sound of the water. Techniques for detecting such audible events are well-known in the audio-processing arts.

Under a typical configuration, the various circuit components of control/monitor interface 404 will be powered by a battery 1344. Optionally, an electrical-based power supply (not shown) may be used. In either case, appropriate power conditioning circuitry and routing (e.g., power planes and the like) will also be used (not shown for clarity).

In general, system software (i.e., firmware) will be stored in ROM 1330. In one embodiment, system software may be loaded from a network store via communication interface 1324. The system software is executed on processor 1320 to perform the operations of the embodiments discussed herein. The system software and/or data will typically be loaded into memory 1328 during initialization operations.

As discussed above, method embodiments of the invention may be implemented via execution of instructions via a processor or the like. Thus, embodiments of this invention may be used as or to support software/firmware components executed upon some form of processing core (such as processors 1200 and 1320) or otherwise implemented or realized upon or within a machine-readable medium. A machine-readable medium includes any mechanism for storing or transmitting information in a form readable by a machine (e.g., a computer). For example, a machine-readable medium can include such as a ROM; a random access memory (RAM); a magnetic disk storage media; an optical storage media; and a flash memory device, etc. In addition, a machine-readable medium can include propagated signals such as electrical, optical, acoustical or other form of propagated signals (e.g., carrier waves, infrared signals, digital signals, etc.).

In addition to embodiments that are used to project an amount of time remaining until sufficient hot water for a shower will run out, embodiments of the invention may be configured to predict an amount of hot water remaining in a hot water tank. For example, the embodiment of FIG. 5 can be employed to predict whether a tank is completely full, half full, or almost empty of hot water. This is advantageous for hot water uses such as baths. Under a typical bath scenario, it is desired to fill a bathtub up to a certain level with water having a desired temperature. If the bather starts filling the bath tub when the amount of hot water remaining is inadequate to fill the bath tub to the desired level, the hot water will be wasted, and the bather will be upset. Embodiments of the invention can be configured to prevent such situations. In this case, the monitor/control interface will usually be mounted proximate to the bath tub.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

These modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. A machine-implemented method for projecting whether a sufficient supply of hot water is available for a bath, comprising:

receiving, at a machine, information specifying a volume or level of water desired for the bath;

receiving, at a machine, information specifying a temperature of the bath water desired for the bath; and projecting, via a machine, whether a hot water supply system used to supply water for the bath can supply a sufficient amount of hot water to fill a bathtub with the specified volume or level of water at the specified temperature, wherein the hot water supply system includes a water heater having a hot water tank, and the projection is performed by monitoring at least one parameter over time related to operation of the water heater and employing data obtained by monitoring the at least one parameter over time to project whether the hot water supply system can supply a sufficient amount of hot water to fill a bathtub with the specified volume or level of water at the specified temperature.

2. The method of claim 1, further comprising providing indicia indicating whether or not it is projected that the hot water supply system can supply a sufficient amount of hot water to fill the bathtub with the specified volume or level of water at the specified temperature.

3. The method of claim 1, further comprising:

detecting, while the bathtub is being filled, that another hot water consumer is consuming hot water from the hot water supply system; and re-projecting whether the hot water supply system can supply a sufficient amount of hot water to fill the bathtub with the specified volume or level of water at the specified temperature.

4. The method of claim 3, further comprising providing a warning to indicate it is projected the hot water supply system will not be able to supply a sufficient amount of hot water to fill the bathtub with the specified volume or level of water at the specified temperature.

5. The method of claim 1, wherein the operation of monitoring at least one parameter over time comprises monitoring a temperature of the water in the hot water tank over time to observe a rate of change of the temperature of the water.

6. The method of claim 5, wherein the temperature of the water in the hot water tank is measured at a plurality of respective depths.

7. The method of claim 5, wherein the temperature is measured using an elongated sensor configured to measure a substantial average temperature of the water in the hot water tank.

8. The method of claim 1, wherein the operation of monitoring at least one parameter related to operation of the water heater further comprises at least one of:

monitoring a temperature of water at a location in the hot water tank, monitoring a temperature of water exiting the hot water tank, or monitoring a temperature of water in a hot water supply line used to supply hot water to the bathtub.

9. The method of claim 1, further comprising employing data obtained by monitoring the at least one parameter over time as at least one input to one of a computer temperature model or a temperature modeling lookup table to project whether the hot water supply system can supply a sufficient amount of hot water to fill the bathtub with the specified volume or level of water at the specified temperature.

10. The method of claim 1, further comprising enabling a bather to specify the desired volume or level of water and the desired temperature of the bath water.

11. The method of claim 1, wherein the hot water supply system includes a water heater having a hot water tank, the method further comprising:

determining a water temperature distribution in the water tank to determine a current hot water supply condition of the hot water supply system; and employing the current hot water supply condition in projecting whether the hot water supply system can supply a sufficient amount of hot water to fill the bathtub with the specified volume or level of water at the specified temperature.

12. An apparatus, comprising:

a processor;

a memory, communicatively coupled to the processor;

at least one sensor interface, communicatively coupled to the processor;

a communication interface, communicatively coupled to the processor; and a persistent storage means communicatively coupled to the processor and having instructions stored therein, which when executed by the processor causes the apparatus to perform operations including:

receiving, via the communication interface, information specifying a volume or level of water desired for a bath;

receiving, via the communication interface, information specifying a temperature of the bath water desired for the bath;

receiving at least one sensor signal via said at least one sensor interface, said at least one sensor signal corresponding to one or more parameters related to operation of a water heater used to supply hot water to a bathtub;

deriving data from the at least one sensor signal and employing the data in projecting whether the water heater can supply a sufficient amount of hot water to fill the bathtub with the volume or level of water desired at the specified temperature; and transmitting data via the communication interface indicating whether the water heater can supply a sufficient amount of hot water to fill the bathtub with the specified volume or level of water at the specified temperature.

13. The apparatus of claim 12, wherein said at least one sensor interface includes a temperature sensor interface to receive temperature measurements from one or more temperature sensors.

14. The apparatus of claim 12, wherein said at least one sensor interface includes a flow rate sensor interface via which a signal indicative of a flow rate of water exiting the water heater is received.

15. The apparatus of claim 12, wherein the communication interface includes a wireless antenna and the computer interface is configured to transmit data using a wireless signal sent via the wireless antenna.

16. The apparatus of claim 12, wherein the persistent storage means further including data comprising a temperature model lookup table defining at least one time versus temperature curve corresponding to at least one water flow rate.

17. The apparatus of claim 12, wherein the persistent storage means includes further instructions, which when executed by the processor performs operations including:

automatically generating a temperature model of a water heater; and storing data corresponding to the temperature model in the persistent storage means.

18. An apparatus, comprising:

a processor;

a memory, communicatively coupled to the processor;

a user input means, communicatively coupled to the processor;

a communication interface, communicatively coupled to the processor;

a display means, including a display driver communicatively coupled to the processor; and a persistent storage means communicatively coupled to the processor and having instructions stored therein, which when executed by the processor causes the apparatus to perform operations including:

receiving, via the user input means, data input by a bather information specifying a volume or level of water desired for a bath;

receiving, via the user input means, data input by a bather specifying a temperature of bath water desired for the bath;

receiving a communication signal via the communication interface, the communication signal containing data corresponding to operating conditions of a water heater;

generating display information in response to the data that are received, the display information including indicia indicating whether a hot water supply system can supply a sufficient amount of hot water to fill a bathtub with the specified volume or level of water at the specified temperature; and displaying the display information on the display means.

19. The apparatus of claim 18, further comprising:

an audio driver communicatively coupled to the processor;

a speaker coupled to the audio driver;

instructions stored in one of the persistent storage means or the audio driver, which when executed by the processor or the audio driver generates an audio signal that is used to drive the speaker to produce an audible warning indicating the hot water supply system cannot supply a sufficient amount of hot water to fill the bathtub with the specified volume or level of water at the specified temperature.

* * * * *